United States Patent [19]

Nezuka et al.

[11] Patent Number: 4,894,634

[45] Date of Patent: Jan. 16, 1990

[54] SWITCH DEVICE

[75] Inventors: Masakazu Nezuka, Gotemba; Yuji Saito, Susono; Yasuhiro Sato, Gotemba, all of Japan

[73] Assignee: Texas Instruments Incorporated, Dallas, Tex.

[21] Appl. No.: 259,833

[22] Filed: Oct. 19, 1988

[51] Int. Cl.[4] ..... H01H 37/74; H01H 37/54

[52] U.S. Cl. ..... 337/343; 337/53; 337/89

[58] Field of Search ..... 337/343, 342, 89, 365, 337/53

[56] References Cited

U.S. PATENT DOCUMENTS

| | | | |
|---|---|---|---|
| 2,421,538 | 6/1947 | Clark . | |
| 2,792,474 | 5/1957 | Dales . | |
| 3,031,551 | 4/1962 | White et al. . | |
| 3,322,920 | 5/1967 | Morris | 337/365 |
| 3,416,116 | 12/1968 | Marcoux . | |
| 4,039,992 | 8/1977 | Givler | 337/365 |

FOREIGN PATENT DOCUMENTS

| | | | |
|---|---|---|---|
| 1357127 | 2/1964 | France | 337/89 |
| 923315 | 4/1963 | United Kingdom | 337/89 |

*Primary Examiner*—H. Broome

*Attorney, Agent, or Firm*—John A. Haug; James P. McAndrews; Melvin Sharp

[57] ABSTRACT

A thermostatic switch is shown in which a movable arm mounting a movable contact and a snap acting thermostatic strip disc are cantilever mounted with the disc adapted to cause the movable contact to move out of engagement with a stationary contact at a selected calibration temperature by engaging the movable arm and moving it and concomitantly the movable contact away from the stationary contact when the disc snaps to its opposite surface configuration.

4 Claims, 3 Drawing Sheets

SWITCH DEVICE

This invention relates generally to a switch device and more particularly, to a switch device that carries out the switching action in conformity with temperature variations.

BACKGROUND OF INVENTION

An electric apparatus such as a motor or the like, generates heat when it is in an abnormal state and if it is continued to be used, burning of the insulating coating of the coil and other parts results, thereby making it impossible for same to be used any longer. In order to prevent this, a switch device (a protective device) is used that opens the contacts by using a bimetal that deforms at the time of an electric current overload or excessive temperature, thereby bring about an OFF state.

Examples of such switch devices are shown in FIGS. 7 through 10.

FIG. 7 shows a top plan view with the housing cut away of a switch device 21, FIG. 8 is a cross section taken along line 8—8 in FIG. 7, and FIG. 9 is an expanded partial cross section of FIG. 8.

In a container 22 made, for example, of cold-drawn steel material, there is provided a first electrically conductive plate 25 electrically separated from container 22 by an insulation sheet 30A at the bottom thereof and a second electrically conductive plate 28 disposed on and electrically separated from plate 25 by an insulation sheet 30B.

A movable contact support plate 23 is fixed as by soldering at the terminal of the first electrically conductive plate 25 and a movable contact 24 is mounted at the tip of the movable contact support plate 23. A bimetal plate 27 is fixed to the first electrically conductive plate 25 by means of a fastener 31.

The movable contact support plate 23 is provided with an aperture **23*b* which spacedly receives therethrough fastener 31, and the movable contact 24 is in contact with stationary contact 29 that has been mounted on the second electrically conductive plate 28**.

In the condition depicted in FIGS. 8 and 9, the protrusions **23*a* and 23*a* at two locations of the movable contact support sheet 23 are separated from the bimetal plate 27 by a dimension d which is shown in FIG. 9, the movable contact 24 compressively engaging the stationary contact 29 by the inherent elasticity of the movable contact support plate 23, the first and second electrically conductive plates 25 and 28 being electrically connected with the switch device 21** in an ON state.

The terminal **25*a* of the first electrically conductive plate 25 is connected with a lead wire 33 and the terminal of the second electrically conductive plate 28 is connected with a lead wire 32. The terminals 25*a* and 28*a* are comprssed or clamped terminals; however, the clamp details are not shown in the drawings. The switch device 21** is installed inside an electric apparatus (such as a motor) which is not shown in the drawing and it is connected in series between the electric apparatus and the electric source.

If the electric apparatus is subjected to an overload during its usage, thereby elevating the temperature and causing the temperature of the switch device 21 to rise or if a large electric current flows, with a result that the movable contact support plate 23 is heated, the temperature of the bimetal 27 also rises and it deforms, thereby engaging the protrusions **23*a* and 23*a* of the movable contact support plate 23 and, if the deformation of the bimetal plate 23 continues, the bimetal plate 27 pushes up and movable contact support plate 23 as shown in FIG. 10, with a result that the movable contact 24 moves away from the fixed contact 29, electrically separating the first and second electrically conductive plates 25 and 28 with a result that the switch device 21** will be in an OFF state, thereby protecting the electric apparatus.

When the condition shown in FIG. 10 occurs, however, the movable contact support plate 23 and the bimetal plate 27 discharge heat, thereby lowering their temperature, and the bimetal plate 27 is restored to its original shape and the movable contact support sheet 23 moves away from the protrusions 23a and 23a, with a result that the switch device returns to the ON state shown in FIG. 9..

If the time between the OFF state of the switch device 21 and its ON state is excessively short, the switch device 21 will move between the ON and OFF states in a short cycle, which is undesirable.

Accordingly, the position of the bimetal 27 in the vertical direction is adjusted by a micro-adjustment means which is not shown in the drawing but which is provided on fastener 31 in such a manner that the distance d between the bimetal 27 and the movable contact support plate 23 may assume a preselected dimension in conformity with the curvature of the bimetal 27 and in conformity with the temperature selected for the aforementioned OFF state (such as, for example, a prescribed temperature in the range between 70 and 150 degrees centigrade). For instance, d is set at one millimeter when the selected temperature for the OFF state is 70 degrees centigrade and d is set at two millimeters when the selected temperature for the OFF state happens to be 100 degrees centigrade. However, this fine adjustment will have to be carried out manually for each switch and, as such, it is troublesome and cannot always be accurate.

If the distance d happens to be excessively large, the switch device 21 turns OFF after the electric apparatus has been left in the abnormal state for an undesirably long time, with a consequence that the protection of the electric apparatus becomes uncertain.

If the distance d happens to be excessively small, on the other hand, the cycle at which the switch device 21 moves between ON and OFF becomes too small. For example, ON and OFF states repeated at the cycle of 0.3 second (which is called chattering) is undesirable and causes fatiguing of the bimetal plate 27 or the movable contact support, thereby making it impossible to carry out normal deformation. If this occurs the device may remain in the ON state if there takes place contact deposition due to a spark, thereby making it impossible to protect the electric appliance.

SUMMARY OF THE INVENTION

The object of the invention is to provide a switch device which does not require a minute positional adjustment of the deformation member (such as the bimetal) that is deformed in conformity with the temperature variations, in order to avoid chattering, and one which is reliable without losing the switching functions through fatigue of the deformation part and consequent contact deposition.

Other objects and features of the invention will become more readily understood from the following description and the drawings in which like reference numerals designate like parts throughout the figures thereof.

Briefly, in accordance with the inventions, a switch device comprises a movable contact which moves in conformity with the deformation of a deformation member that is deformed in accordance with variations in its temperature. Switching is effected by the moving contact which is adapted to move into and out of engagement with a stationary contact. According to a feature of the invention a movable member mounting the movable contact and the deformation member are mutually fixed at a location which is different from the movable contact. With the movable member being biased in accordance with the deformation of the deformation member.

BRIEF DESCRIPTION OF THE DRAWINGS

FIG. 1 is an internal plan view of the switch device.

FIG. 2 is a cross section taken along line 2—2 in FIG. 1.

FIG. 3 is a cross section of a switch device which is in the OFF state.

FIG. 4 shows circuitry for connection between a switch device and a motor.

FIG. 5 and FIG. 6 show the handle of an electric drill which is equipped with a switch device, FIG. 5 showing the side of same and FIG. 6 showing a partly broken away front view of same.

FIG. 7 is an inner plan view of a switch device.

FIG. 8 is a cross section taken along line 8—8 in FIG. 7.

FIG. 9 is a partially expanded view of FIG. 7.

FIG. 10 is a cross section of a switch device which is in the OFF state.

Figure 1:
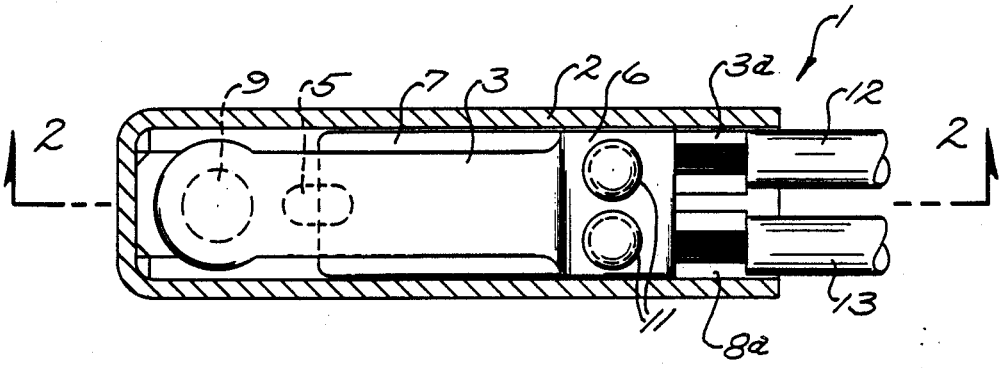
FIGS. 1 through 6 show a preferred embodiment of the invention.
Figure 2:
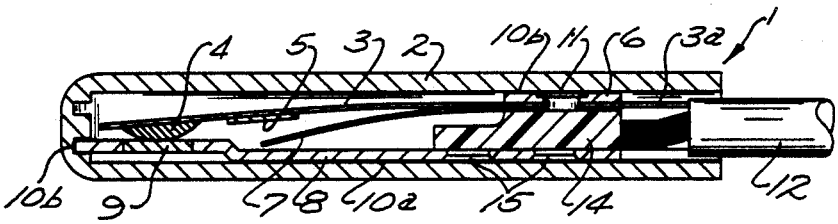

With particular reference to FIGS. 1 and 2, an electrically conductive plate 8 is fixed by means of fasteners 15 and 15 through an insulation layer 10A on the bottom of a generally tubular housing 2 which, for example, is made of a cold rolled steel plate. The distal end portion of plate 8 is shown locked in a groove formed in the end wall of housing of and electrically insulated therefrom by insulation layer 10B. A stationary contact 9 is provided at one end of the electrically conductive plate 8, with the other end serving as a terminal 8*a*.

A block 14 of electrically insulative material such as resin, is disposed on the electrically conductive plate 8 adjacent the open end of housing 2. End portions of the bimetal strip disc 7 and the movable contact support plate 3 (movable elongated strip or arm with a movable contact mounted thereon) are overlapped and cantilever mounted on block 14 with disc 7 beneath movable arm 3. A brass plate 6 is further placed on top of the assembly and these are fixed to the resin block 14 by means of a fastener 11.

By this mounting, a portion of the bimetal disc 7, the terminal side of the movable contact support arm 3 and the brass plate 6 are held tightly together from below in this order. On the surface of the brass plate 6 and fastener 11, there is provided an insulation layer 10B, which provides electrical insulation vis-a-vis the housing 2.

The bimetal disc 7 is curved toward the lower distal free end, the disc having a downwardly facing concave surface configuration in its normal at rest condition. A movable contact 4 is mounted on the distal free end of arm 3 and is adapted to move into and out of engagement with stationary contact 9 and, in the normal state, the movable contact 4 is biased against stationary contact 9 by the inherent elasticity of the movable contact arm 3 which is formed of material having good electrical and spring characteristics. That is, the movable contact arm 3 and the electrically conductive plate 8 are normally electrically connected with the switch device 1 in the ON state.

A terminal 3*a* is formed at the end beyond the mounting portion of the movable arm 3 (on the right side of the drawing) and the terminal 8*a* is formed at the end which is opposite to the stationary contact 9 of the electrically conductive plate 8 (on the right hand side in the drawing) with the terminal 3*a* being connected to a lead wire 12 and the terminal 8*a* being connected to a lead wire 13. These connections are effected in a conventional manner as by clamping; however, the clamp details are not shown in the drawing.

Figure 4:
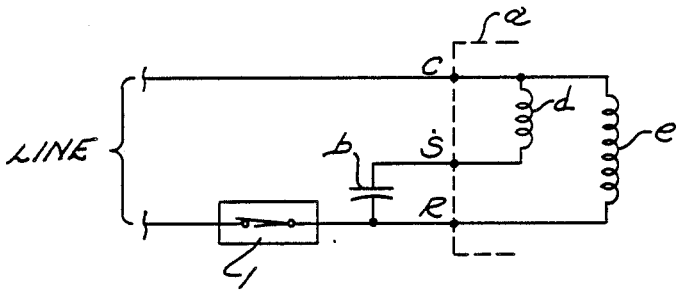

FIG. 4 shows circuitry as an example of the connection between the switch device 1 and an electric apparatus (motor a in the example shown in the drawing). In FIG. 4 switch device 1 is shown serially connected to capacitor b which is in turn connected to start wind d and to main winding e.

Figure 3:
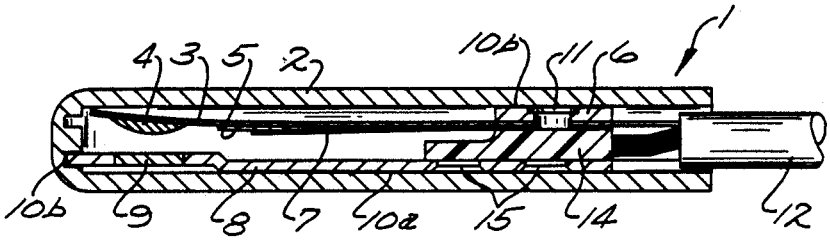

If an electric appliance experiences some kind of trouble causing its temperature to increase, with a result that the temperature of the switch device 1 rises or if a large electric current flows, thereby causing the movable contact support arm 3 to be heated, the bimetal disc 7 is deformed, with its free end moving upwardly, eventually the free end of the bimetal plate 8 contacting a wear-resistant contact plate 5 that is provided on the movable contact support arm 3 and, if the deformation of the bimetal 7 still continues, the movable contact support arm 3 is pushed by the bimetal disc 7 whose deformation has progressed as shown in FIG. 3, thereby being warped upwardly, causing separation of the movable contact 4 from the stationary contact 9, with a result that the switch device 1 assumes an OFF state.

What is noteworthy in this example is the fact that the following phenomenon takes place in the stage where the switch device 1 moves from the ON state to the OFF state:

The bimetal plate 7 is curved downward in the ON state as shown in FIG. 2, i.e., it has a downwardly facing concave surface configuration but is deformed in such a manner as to assume an opposite downwardly facing convex surface configuration, i.e., upwardly warped as shown in FIG. 3. During the initial period when the bimetal disc 7 has its temperature elevated from the state shown in FIG. 2 to the state shown in FIG. 3, the deformation of the bimetal disc progresses gradually along with the elevation of the temperature and, at the time when it has assumed a prescribed shape, deformation progresses quickly.

In other words, the deformation of the bimetal disc 7 progresses gradually until the amount of deformation has reached a threshold value and when the amount of said deformation has reached this threshold value, the deformation progresses quickly. The step in which the deformation progresses gradually during the initial stage is called creep.

The step in which the deformation progresses rapidly is called snap action. The snap action of disc 7 rapidly pushes support arm 3 upwardly, with a result that the movable contact 4 is rapidly separated from the stationary contact 9 thereby avoiding contact deposition by sparking.

Since one end of the bimetal disc 7 is tightly mounted to the movable contact support arm 3, it is only necessary to select a bimetal disc 7 having a curvature which conforms to the aformentioned set temperature.

Figure 8:
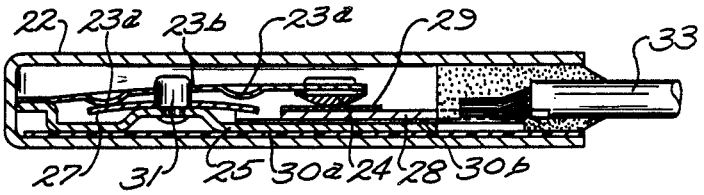
Figure 9:
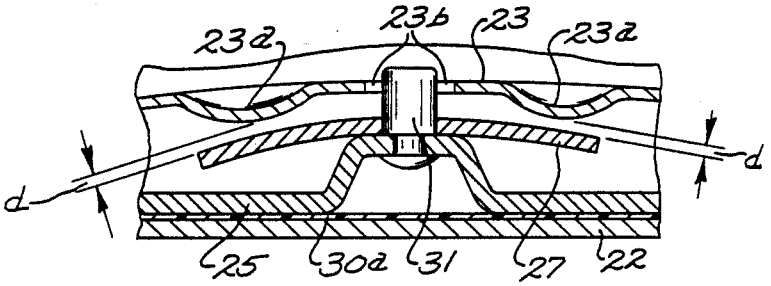
Figure 10:
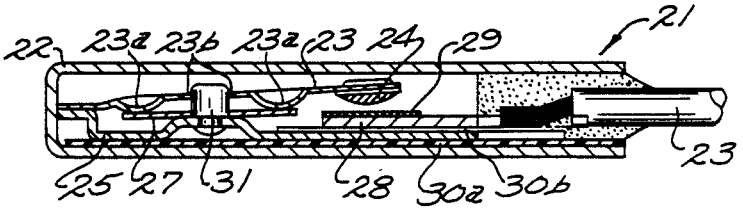

Accordingly, it is not necessary to make an adjustment of the aforementioned distance as described above in connection with FIGS. 8–10. At the same time, it is easy to assemble and it does not develop chattering and contact point welding stemming from an error in the adjustment of the aforementioned distance.

In the case where the OFF state in FIG. 3 changes to the ON state in FIG. 2, too, the deformation of the bimetal disc 7 rapidly progresses after the passage of the creep of the initial stage of deformation, with a result that the movable contact 4 compressively engages the stationary contact 9.

By the aforementioned deformation of the bimetal disc 7, there will be no development of chattering, the bimetal disc 7 and the movable contact support arm 3 will not be so fatigued as to stop functioning normally, there will be no contact welding, the switch device 1 will retain its switch functions for a longer period of time and the protection of the electric appliance thus becomes more reliable and accurate.

The mounting portions of the bimetal disc 7, the movable contact support arm 3 and the brass plate 6 are in close heat transfer relation with one another so that at the time when the switch device 1 shifts from the ON state shown in FIG. 2 to the OFF state shown in FIG. 3, therefore, the bimetal disc 7 receives heat by heat conduction from the brass plate 6 which serves as a heat sink and the movable contact support arm 3, both of which have their temperature elevated, with a result that the lowering of the temperature of the bimetal take splace gradually in a way different from the case of natural cooling.

Therefore, the time during which the switch device 1 remains in the OFF state shown in FIG. 3 is increased. This is convenient for the elimination of the cause of the trouble of the electric appliance, thereby making it easier to maintain.

Figure 5:
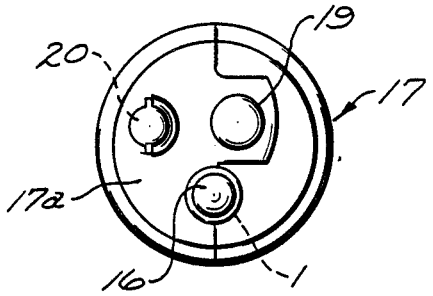
Figure 6:
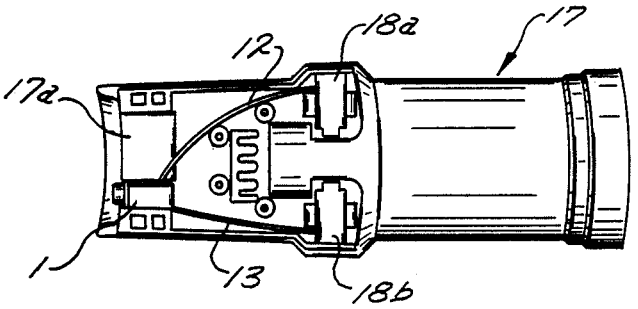
Figure 7:
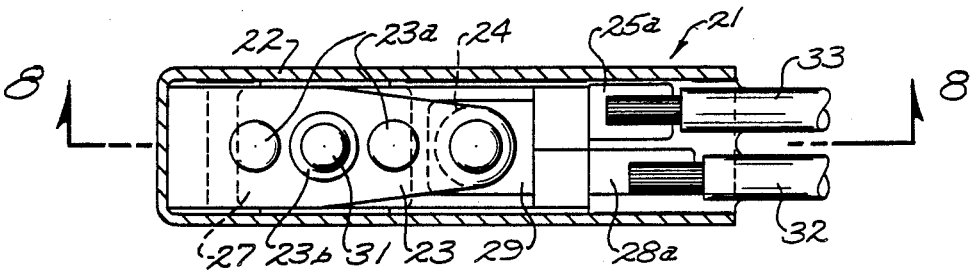
FIGS. 7 through 10 show prior art examples.

FIGS. 5 and 6 show the handle of an electric drill with the switch device 1 installed thereon, with FIG. 5 showing the side view and FIG. 6 showing a partly cut away front view.

As is shown in FIG. 5, the button 16 of a power switch sticks out of an aperture that is provided on the cover 17*a* on the side of the handle 17. In the drawing, numeral 19 indicates a fuse box, and 20 is a lever for removing the cover.

As shown in FIG. 6, the switch device 1 is installed on the handle part 17 inside the cover 17*a* and the lead wires 12 and 13 are connected with the terminals 18A and 18B inside the handle 17.

The switch device according to this invention can be used for the protection of various electric appliances in a wide range. It is particularly suitable for the protection of a battery pack (including a dry cell) from short-circuiting and protection from over-load by being directly connected with the coil of a small-sized motor.

Aside from the aforementioned various examples, various other forms can be used on the basis of the technical concept of this invention. For example, the shape of the bimetal can be such as is suitable for the development of a creep action and the location of the installation of a movable contact may have a suitable shape in conformity with the structure and shape of the switch device.

In addition, it is possible to use some other type deformable member that will be deformed in conformity with the variations in temperature.

The objects of protection do not include the motors and other electric appliances alone. Instead, the switch device according to this invention can be used in the protection or control or various electrical machines and apparatus.

As has been explained above, it is possible according to the switch device of this invention, in which a deformable member that deforms in accordance with the variations in the temperature and a movable arm that has a movable contact mounted thereon are mutually fixed at a location which is different from the movable contact and the end of the deformable member is free, to have the distance between the free end of the deformable member and the movable arm at any value suitable for the temperature at which the switching is carried out at all times. Accordingly, there is no need to adjust the distance between the deformable member and the movable arm as in conventional switch devices, with a result that it becomes easier to assemble same. In addition, there will take place no chattering or contact welding based on the error of this adjustment, with a consequence that protection of the electric appliances can be carried out accurately for a long period of time with high reliability.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed:

1. A switch device comprising a housing forming a switch chamber, a stationary electrical contract mounted in the housing, an elongated movable contact arm having two opposite ends, one end mounting thereon a movable electrical contact adapted to move into and out of engagement with the stationary contact to respectfully close and open an electrical circuit, a bimetallic member having two opposite ends, a support mounted in the housing, an end of the bimetallic member and the other end of the movable contact arm placed one on top of the other and cantilever mounted on the support, a heat sink member mounted in heat transfer relationship with the cantilever mount of the movable contact arm and the bimetallic member, the movable contact arm and the bimetallic member both extending into the switch chamber in generally the same direction but with the free end of the bimetallic member spaced from the movable contact arm during normal operating conditions, the movable contact being biased into engagement with the stationary contact during normal operating conditions and the bimetallic member deformable in dependence on variations in its temperature so that with increasing temperature the free end of the bimetallic member moves toward the movable contact arm.

2. A switch device according to claim 3 in which the bimetallic member is a snap acting disc and the free end of the disc is spaced from the movable contact arm a distance greater than the amount that the disc creeps prior to snap action.

3. A switch device according to claim 2 in which a wear resistant member is mounted on the movable contact arm aligned with and facing the free end of the disc.

4. A switch device according to claim 2 in which the housing is generally tubular having an open end and the support is disposed adjacent the open end.

* * * * *